US007325423B2

(12) United States Patent
No et al.

(10) Patent No.: US 7,325,423 B2
(45) **Date of Patent: *Feb. 5, 2008**

(54) DRUM-TYPE WASHING MACHINE

(75) Inventors: Yang Hwan No, Changwon-si (KR); Jong Seok Kim, Changwon-si (KR); Han Ki Cho, Changwon-si (KR); Yeon Su Jung, Changwon-si (KR); Jung Hoon Kang, Changwon-si (KR); Young Hoon Ha, Masan-si (KR); Myung Sik Park, Changwon-si (KR)

(73) Assignee: LG Electronics Inc., Seoul (KR)

( * ) Notice: Subject to any disclaimer, the term of this patent is extended or adjusted under 35 U.S.C. 154(b) by 640 days.

This patent is subject to a terminal disclaimer.

(21) Appl. No.: 10/746,154

(22) Filed: Dec. 29, 2003

(65) Prior Publication Data

US 2004/0194514 A1 Oct. 7, 2004

(30) Foreign Application Priority Data

Dec. 30, 2002 (KR) ..... 10-2002-0086938

(51) Int. Cl.
*D06F 39/06* (2006.01)

(52) U.S. Cl. ..... 68/13 R; 68/142

(58) Field of Classification Search ..... 68/5 R, 68/13 R, 18 R, 139, 142; 134/186
See application file for complete search history.

(56) References Cited

U.S. PATENT DOCUMENTS

| | | | | |
|---|---|---|---|---|
| 2,153,812 A | | 4/1939 | Newton | 166/325 |
| 2,223,509 A | | 12/1940 | Brauer | 137/67 |
| 2,940,467 A | | 6/1960 | Smith | 137/432 |
| 2,953,159 A | * | 9/1960 | Geschka et al. | 137/587 |
| 3,270,529 A | * | 9/1966 | Engel | 68/18 F |
| 3,608,339 A | * | 9/1971 | Mazza | 68/208 |
| 4,821,537 A | | 4/1989 | Zinkann et al. | 68/208 |
| 5,596,889 A | * | 1/1997 | Guerra et al. | 68/12.02 |
| 5,687,440 A | * | 11/1997 | Min et al. | 8/158 |
| 5,768,730 A | * | 6/1998 | Matsumoto et al. | 8/159 |
| 6,217,770 B1 | | 4/2001 | Haney et al. | 210/636 |
| 2004/0187528 A1 | * | 9/2004 | No et al. | 68/17 R |

FOREIGN PATENT DOCUMENTS

| | | | |
|---|---|---|---|
| DE | 38 04 328 | * | 2/1988 |
| DE | 197 31 667 | * | 7/1997 |
| JP | 2-45091 | * | 2/1990 |
| JP | 10-15272 | * | 1/1998 |
| JP | 10-235069 | * | 9/1998 |

* cited by examiner

*Primary Examiner*—Frankie L. Stinson
(74) *Attorney, Agent, or Firm*—Ked & Associates LLP

(57) ABSTRACT

A drum-type washing machine is disclosed which includes a ventilation apparatus that provides an air passage for an inner space of a tub to communicate with an external atmosphere. The ventilation apparatus employs a bubble dissipation device that prevents bubbles generated in the tub from reaching a ventilating bellows and being discharged from a cabinet of the washing machine. The ventilation apparatus includes a ventilating duct formed at an upper part of the tub; a ventilating bellows, one end of which is coupled to an exterior surface of the cabinet and the other end of which is connected to the ventilating duct, to allow a passage of aim the tub to the external atmosphere; and a bubble dissipation device, vertically installed along the air passage of the ventilation apparatus, for preventing bubbles generated in the tub from being discharged from the cabinet. The bubble dissipation device includes a float movably disposed in the ventilation apparatus to travel between a seated stated and a raised state, under a force of a forming air bubble, for blocking the air passage of the ventilating bellows when a bubble is generated and allowing the air of the ventilation apparatus to pass freely when no bubble is generated.

24 Claims, 5 Drawing Sheets

DRUM-TYPE WASHING MACHINE

This application claims the benefit of Korean Application No. 10-2002-0086938 filed on Dec. 30, 2002, which is hereby incorporated by reference.

BACKGROUND OF THE INVENTION

1. Field of the Invention

The present invention relates to a drum-type washing machine, and more particularly, to a drum-type washing machine having a ventilation apparatus employing a bubble dissipation means in a ventilating duct formed in an upper part of a tub.

2. Discussion of the Related Art

Generally speaking, laundering using a drum-type washing machine is carried out using a frictional force between the laundry and a drum rotatably installed within a tub and receiving the driving force of a motor, which has advantages of causing little damage to the laundry, preventing a tangling of the laundry, and achieving such washing effects as beating and rubbing. A drum-type washing machine is provided with side-door access to the interior of the drum inside the tub, which is a tightly closed space when the side door is closed. Therefore, to guard against accidental suffocation, such a washing machine typically includes a ventilation apparatus as an air supply means, providing an air passage for the inner space of the washing machine to communicate with the external atmosphere.

A conventional ventilation apparatus is comprised of a ventilating duct formed at an upper part of the tub and a ventilating bellows, one end of which is coupled to an exterior surface of a cabinet forming the exterior surface of the washing machine and the other end of which is tightly connected to the ventilating duct, to allow the passage of air in the tub to the exterior of the washing machine. During operation, however, air bubbles formed of washing water are inherently generated in the tub when water is supplied to the tub and the drum is rotated, and the bubble surfaces contain laundry dirt, detergent, and the like. The bubbles of air escape from the tub through the ventilating duct and the ventilating bellows, to be discharged and burst outside the cabinet, thus causing a contamination of cabinet surfaces and the cabinet's installation area.

SUMMARY OF THE INVENTION

Accordingly, the present invention is directed to a drum-type washing machine that substantially obviates one or more of the problems due to limitations and disadvantages of the related art.

An object of the present invention, which has been devised to solve the foregoing problem, lies in providing a drum-type washing machine having a ventilation apparatus employing a bubble dissipation means for preventing bubbles generated in a tub from reaching a ventilating bellows and being discharged from a cabinet of the washing machine.

It is another object of the present invention to provide a drum-type washing machine having a ventilation apparatus, which prevents a contamination of cabinet surfaces and the cabinet's installation area.

Additional features and advantages of the invention will be set forth in the description which follows, and in part will be apparent to those having ordinary skill in the art upon examination of the following or may be learned from a practice of the invention. The objectives and other advantages of the invention will be realized and attained by the subject matter particularly pointed out in the specification and claims hereof as well as in the appended drawings.

To achieve these objects and other advantages in accordance with the present invention, as embodied and broadly described herein, there is provided a drum-type washing machine having a ventilation apparatus providing an air passage for an inner space of a tub to communicate with an external atmosphere. The ventilation apparatus comprises a ventilating duct formed at an upper part of the tub; a ventilating bellows, one end of which is coupled to an exterior surface of the cabinet and the other end of which is connected to the ventilating duct, to allow a passage of air in the tub to the external atmosphere; and bubble dissipation means, vertically installed along the air passage of the ventilation apparatus, for preventing bubbles generated in the tub from being discharged from the cabinet. The bubble dissipation means is preferably installed in the ventilating duct of the ventilating apparatus and comprises a float movably disposed in the ventilation apparatus to travel a predetermined vertical distance along the ventilation apparatus between a seated stated and a raised state, under a force of a forming air bubble, for blocking the air passage of the ventilating bellows when a bubble is generated and allowing the air of the ventilation apparatus to pass freely when no bubble is generated.

It is to be understood that both the foregoing explanation and the following detailed description of the present invention are exemplary and illustrative and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings:

FIG. 6A is a cross-sectional view of the ventilation apparatus of the present invention, as if along a line VI-VI of FIG. 5, illustrating the float of the bubble dissipation means in a raised state, i.e., with a generation of bubbles in the tub.

DETAILED DESCRIPTION OF THE PREFERRED EMBODIMENTS

Reference will now be made in detail to the preferred embodiments of the present invention, examples of which are illustrated in the accompanying drawings. Throughout the drawings, like elements are indicated using the same or similar reference designations.

Figure 1:
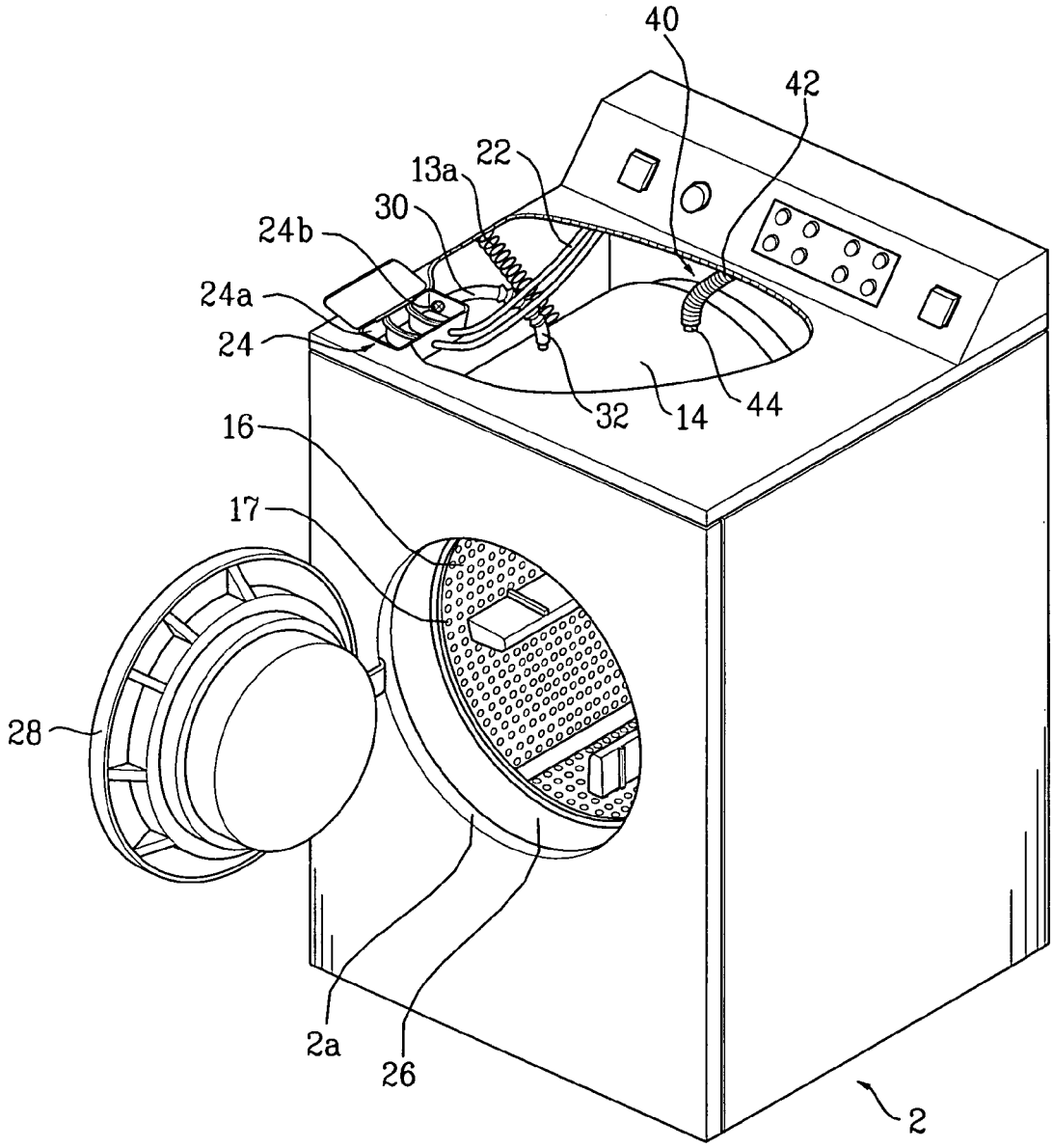
FIG. 1 is a partially cutaway perspective view of the drum-type washing machine according to the present invention.
Figure 2:
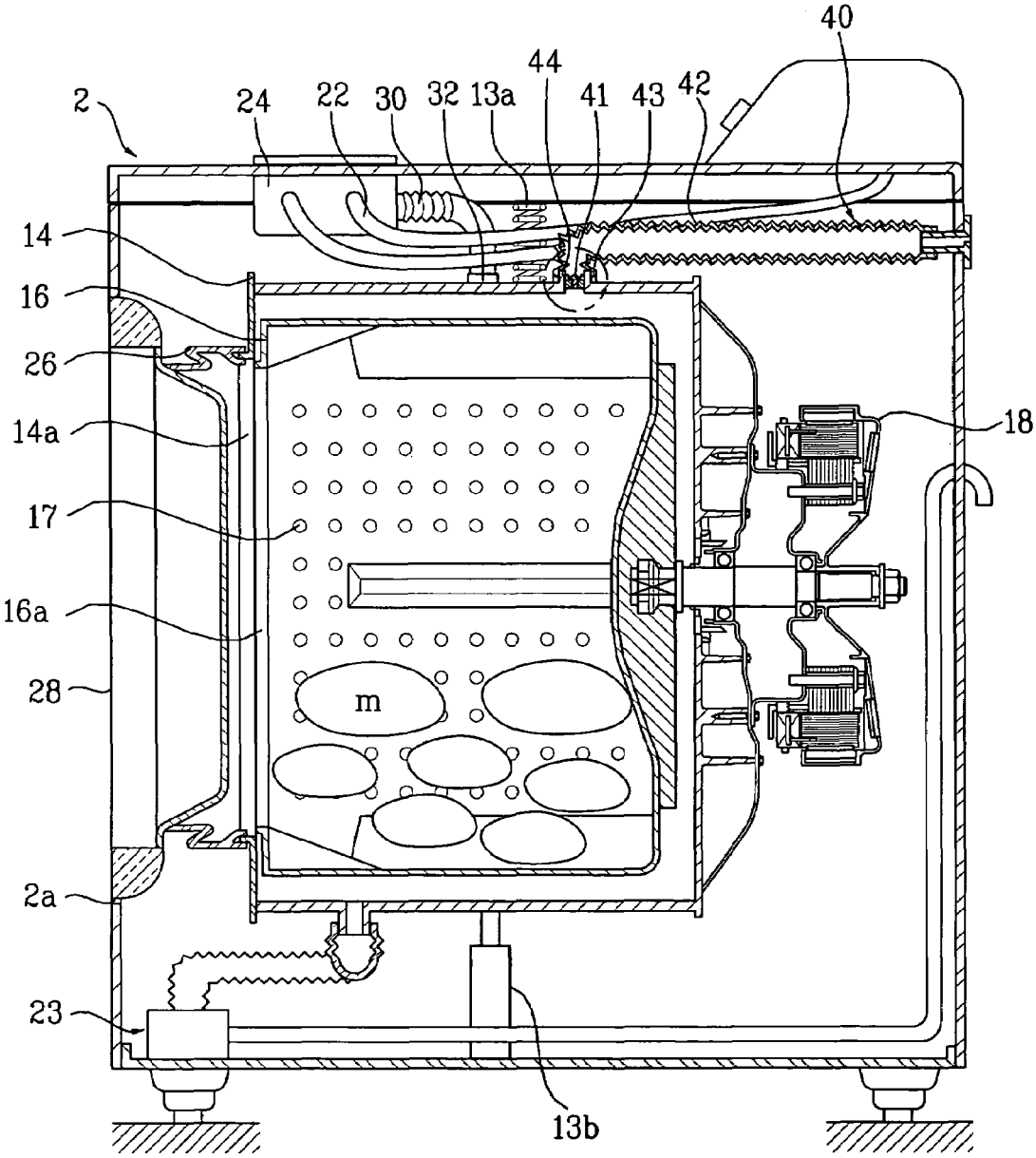
FIG. 2 is a cross-sectional side view of the interior of the drum-type washing machine shown in FIG. 1, highlighting the ventilation apparatus of the present invention.

Referring to FIGS. 1 and 2, a drum-type washing machine according to the present invention is comprised of a cabinet 2 having a front surface in which a laundry entrance 2*a* is centrally formed; a tub 14, installed to be supported in the cabinet by an interoperation of a spring 13*a* and a damper 13*b*, having a forward tub opening 14*a* corresponding to the laundry entrance; a drum 16 for accommodating laundry m, rotatably disposed in the tub, having a forward drum opening 16*a* corresponding to the laundry entrance and a multitude of dewatering holes 17 formed in its circumferential side surface; a driving motor 18, mounted on a rear surface of the tub, for rotating the drum; a detergent box 24 for storing a detergent and a softening agent, disposed above the tub and communicating with a water supply hose 22 for connection to a water source (not shown), the detergent box having a water supply passage 24*a* for passing water through the detergent box during washing and rinsing operations and a water outlet 24*b* formed at one end of the water supply passage; a water supply duct 32, formed at an upper part of the tub and connected to the water outlet of the detergent box via an inlet bellows 30, for supplying washing water to the tub; a water discharging device 23 for discharging water from the tub; a gasket 26, connecting the forward tub opening to the laundry entrance of the cabinet and thereby preventing spillage between the tub and cabinet; a door 28 mounted in the laundry entrance of the cabinet; and a ventilation apparatus 40 providing an air passage for the inner space of the tub to communicate with the atmosphere of the exterior of the cabinet.

The ventilation apparatus 40 comprises a ventilating duct 44 formed at an upper part of the tub 14; a ventilating bellows 42, one end of which is coupled to an exterior surface of the cabinet 2 and the other end of which is tightly connected to the ventilating duct, to allow the passage of air in the tub to the exterior of the washing machine; and a bubble dissipation means 41, vertically installed in the ventilating duct of the ventilation apparatus, for preventing bubbles generated in the tub from reaching the ventilating bellows and being discharged from the cabinet of the washing machine. While the bubbles are stopped by the bubbles dissipation means 41, the air of the ventilation apparatus 40 is allowed to pass freely from the cabinet exterior to the tub interior. The ventilating bellows 42 is tightly secured to an upper end of the ventilating duct 44 with a clamp 43, to create a seal between the ventilating bellows and the ventilating duct and to avoid inadvertent separation of the ventilating bellows from the ventilating duct.

Figure 3:
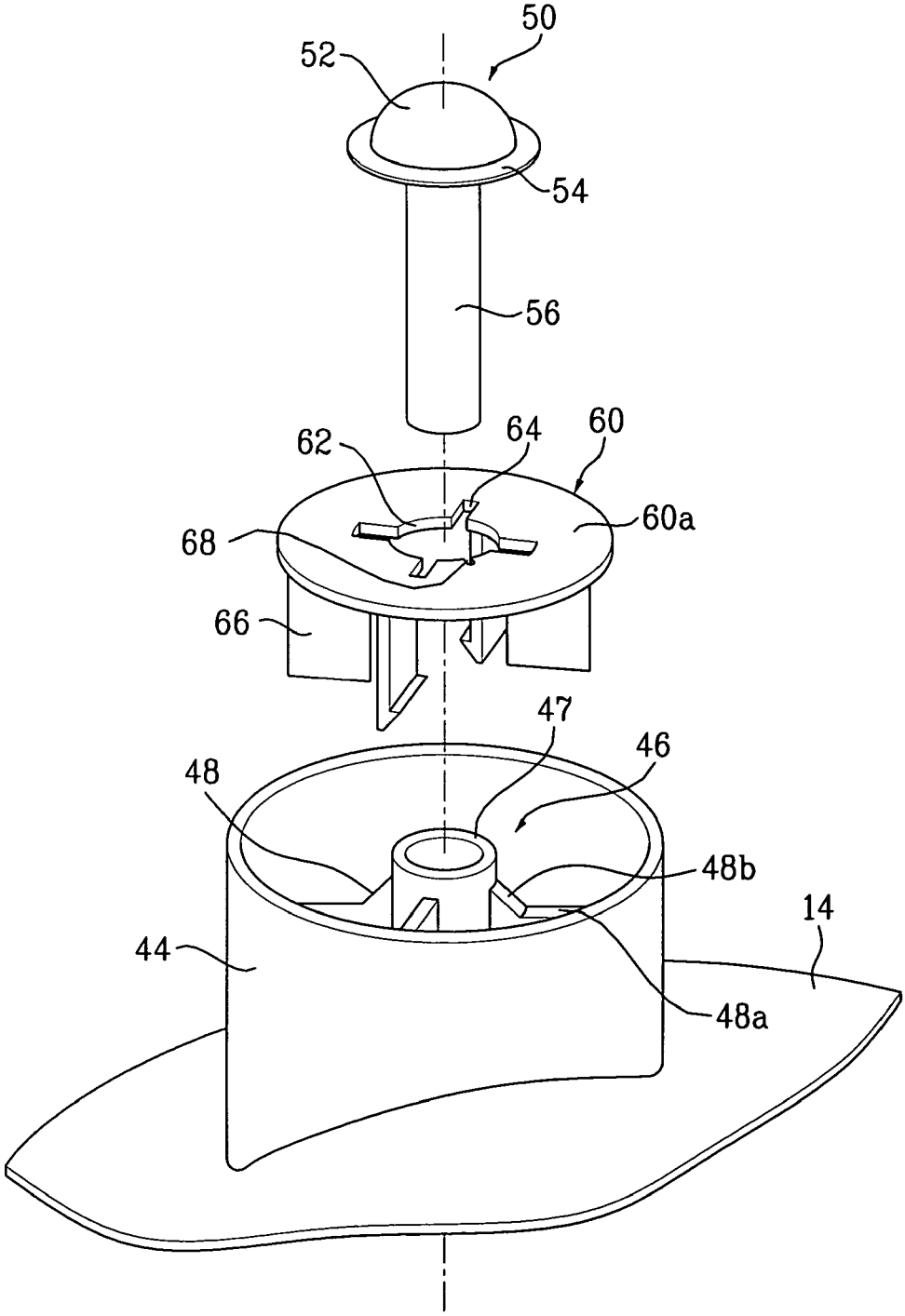
FIG. 3 is an exploded perspective view of the ventilating duct and bubble dissipation means of FIG. 2.
Figure 4:
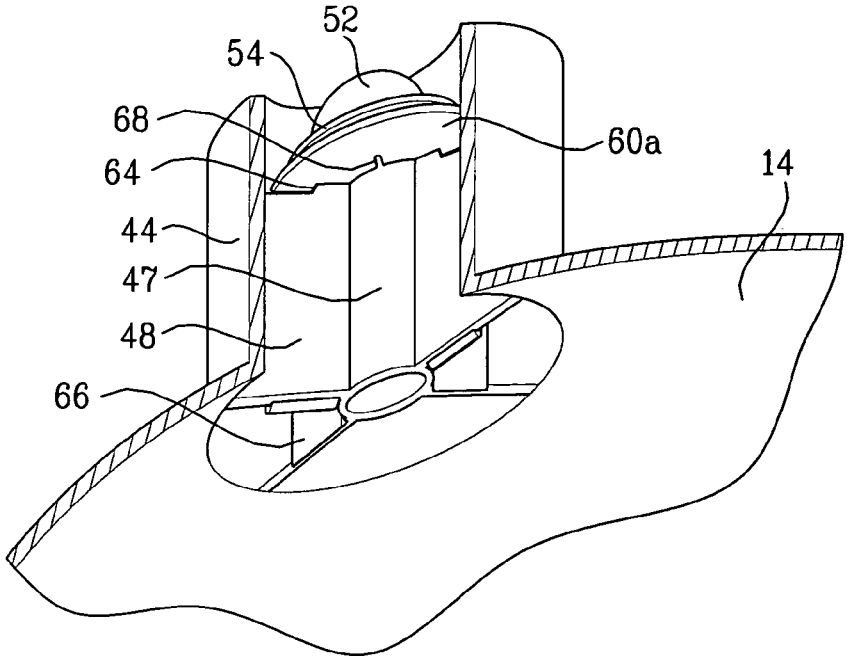
FIG. 4 is a partially cutaway perspective view of the ventilating duct and bubble dissipation means of FIG. 2.

Referring to FIGS. 3 and 4, the bubble dissipation means 41 comprises a fixed guide 46 formed on an inner circumferential surface of the ventilating duct 44 of the ventilation apparatus; a float 50, movably disposed in the ventilating duct of the ventilation apparatus 40 by traveling a predetermined vertical distance along the fixed guide between a seated stated and a raised state, under the force of a forming air bubble, for momentarily closing the mouth of the ventilating bellows 42 and thus temporarily blocking the air passage of the ventilation apparatus when bubbles are generated and allowing the air of the ventilation apparatus to pass freely when no bubbles are generated; and an air intercepting plate 60, fixed to the fixed guide and disposed under the float, for intercepting air passing through the ventilating duct toward the ventilating bellows 42. The bubble dissipation means 41 is provided with an air escape hole 68 having a small cross-section, communicating between the interior of the tub 14 and a space created when the float 50 is in a raised state, for allowing air trapped by the float 50 to escape slowly back into the tub 14 and thereby allow the float to lower when a bubble dissipates. The air escape hole 68 is small enough to restrict airflow and thus slow the lowering of the float 50.

Though shown in the drawings as being installed in the ventilating duct 44, it should be appreciated that the same effect may be achieved by installing the bubble dissipation means 41 elsewhere along the ventilation apparatus 40.

The fixed guide 46 comprises a cylindrical sleeve 47, centrally positioned in the ventilating duct 44, having an outer diameter to allow seating of the air intercepting plate 60 and having an inner diameter for receiving the float 50 with a substantially vertical orientation; and a plurality of radial ribs 48, radiating at a constant interval from the cylindrical sleeve to an inner surface of the ventilating duct, to support the cylindrical sleeve in the center of the ventilating duct. The upper edge of each of the radial ribs 48 has a horizontal surface 48*a* formed next to the ventilating duct 44 and an inclined portion 48*b* extending from the horizontal surface and sloping upward to the cylindrical sleeve 47.

The float 50 comprises a cylindrical rod 56 to be received by the cylindrical sleeve 47 of the fixed guide 46 and enable guiding by the fixed guide, the cylindrical rod forming a hollow shaft extending between an open upper end and an open lower end; a hemispherical head 52, formed at the open upper end of the cylindrical rod, having a smaller diameter than an inner diameter of the ventilating bellows 42, to protrude into the mouth of the ventilating bellows; and an annular rib 54, projecting from a lower perimeter of the hemispherical head, having a diameter greater than the inner diameter of the ventilating bellows, to engage with the mouth of the ventilating bellows so that the float is largely retained in the ventilating duct 44, but having a diameter smaller than the inner diameter of the ventilating duct to allow a flow of air from the ventilating bellows. The hemispherical head 52 is in essence a hollow dome communicating with the cylindrical rod 56, to form an air chamber facilitating the buoyancy of the float 50, whereby the hemispherical head and cylindrical rod impart a buoyancy sufficient to lift the float under the force of a forming air bubble. Thus, the float 50 is lifted by bubbles filling and rising in the ventilating duct 44 of the tub 14, which cause the float to slide up along the cylindrical sleeve 47 of the fixed guide 46 and close the ventilating bellows 42 when bubbles are generated. After the dissipation of the bubbles, the float 50 slides back down and becomes seated in the cylindrical sleeve 47 of the fixed guide 46, to rest atop the air intercepting plate 60.

The air intercepting plate 60 comprises a disc 60*a* having a diameter greater than the annular rib 54 of the float 50, to prevent a false operation of the float (i.e., becoming unseated in the absence of bubble generation) by a flow of air due to a sudden pressure change in the washing machine when the door 28 is closed; and a plurality of hooking planes 66 extending from the bottom surface of the disc to correspond to the radial ribs 48 of the fixed guide 46, to be respectively hooked on a lower edge of the radial ribs such that the disk is firmly seated on the horizontal surfaces 48*a* of the radial ribs. The hooking planes 66 fix the air interrupting plate 60 to the fixed guide 46 to prevent a lifting of the air interrupting plate by air passing through the ventilating duct 42 and entering the ventilating bellows 42. A center hole 62, having a diameter for receiving the cylindrical sleeve 47 of the fixed guide 46, is centrally formed in the disk 60*a* of the air interrupting plate 60, and a plurality of radial slits 64 are formed in the perimeter of the central hole, for respectively receiving the inclined portions 48*b* of the radial ribs 48, to determine a seating orientation of the air interrupting plate. The air escape hole 68, for allowing air trapped by the float 50 to escape slowly back into the tub 14, is formed at a predetermined position of the perimeter of the center hole 62.

Figure 5:
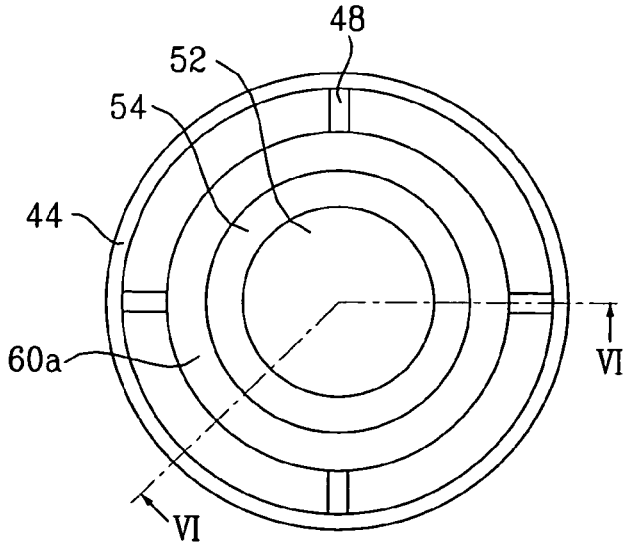
FIG. 5 is a plan view of the ventilating duct and bubble dissipation means of FIG. 2.
Figure 6A:
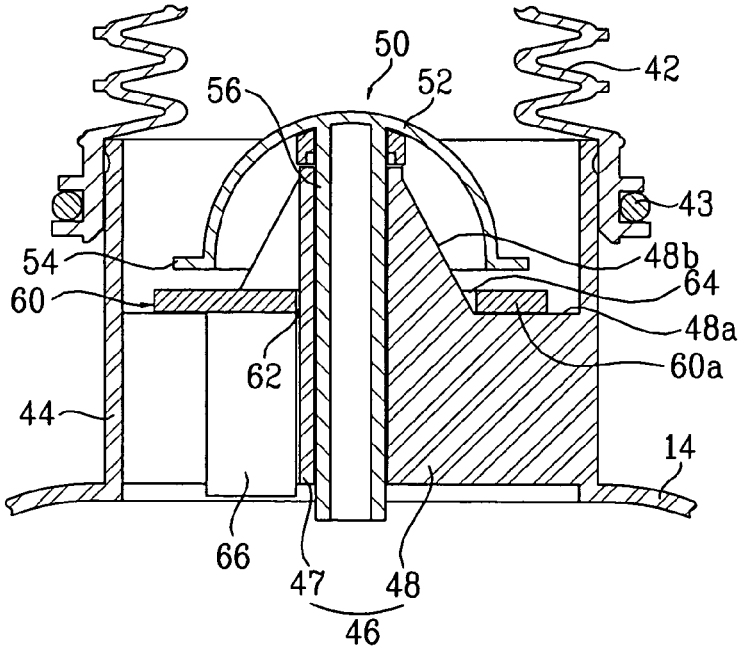
FIG. 6A is a cross-sectional view of the ventilation apparatus of the present invention, as if along a line VI-VI of FIG. 5, illustrating the float of the bubble dissipation means in a seated state, i.e., without a generation of bubbles in the tub.
Figure 6B:
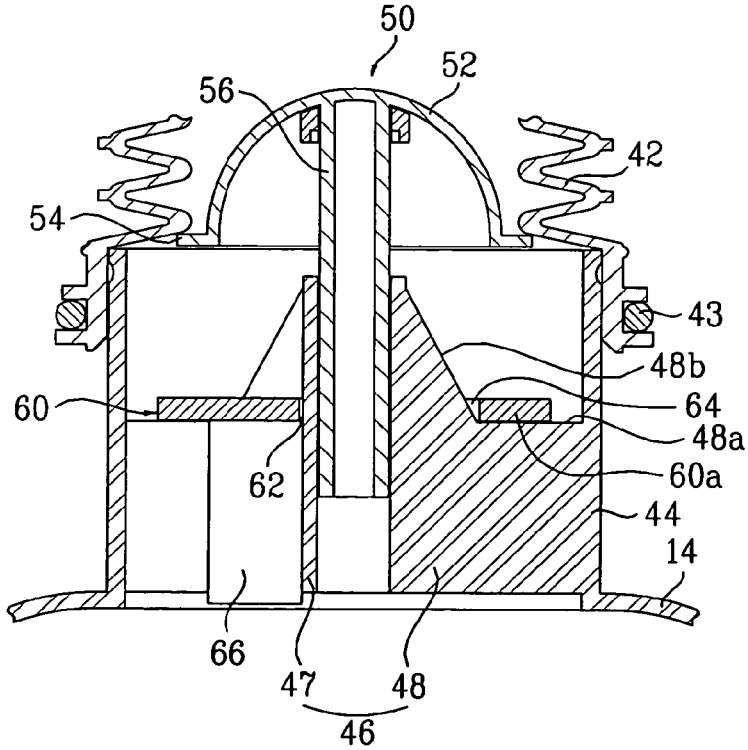

Referring to FIG. 5 and FIGS. 6A and 6B illustrating the operation of the ventilation apparatus 40 configured as above, as the drum 16 is rotated in washing water filling the tub 14 and bubbles are thus generated, air flows out of the tub and into the ventilating duct 44 where the bubbles are formed. The generation of bubbles is particularly great when a large amount of detergent is present in the washing water or when the rotation speed of the drum 16 is great. The float 50 is raised to a predetermined height under the force of the forming bubbles, guided by the cylindrical rod 56 sliding up the cylindrical sleeve 47 of the fixed guide 46, thus closing off the ventilating bellows 42 and preventing the bubbles from entering the ventilating bellows. As long as the bubbles are present under the hemispherical head 52, the float 50 is held in the raised position and the mouth of the ventilating bellows 42 is closed. As soon as the bubbles dissipate (burst), or are no longer generated in the tub 14, the air trapped by the float 50 leaks though the air hole 68 and flows back into the tub, whereby the float is slowly lowered by its own weight.

As described above, a drum-type washing machine having a ventilation apparatus according to the present invention comprises a bubble dissipation means for preventing bubbles generated in the tub from reaching the ventilating bellows of the ventilation apparatus and being discharged from the cabinet of the washing machine, while allowing the air of the ventilation apparatus to pass freely from the cabinet exterior to the tub interior. In doing so, a float is lifted along a fixed guide by the generation of bubbles in the tub, closing the ventilation bellows of a ventilation apparatus until the dissipation of the bubbles, and an air intercepting plate prevents a false operation of the float by intercepting a flow of air beneath the float. In preventing the discharge of bubbles from the tub as above, the ventilation apparatus prevents a contamination of the cabinet surfaces and the cabinet's installation area, and since a lifting and lowering of the float is guided by the fixed guide, with its buoyancy facilitated by an air chamber formed in its hemispherical head to protrude into the ventilating bellows upon bubble generation, the prevention of bubble discharge is achieved accurately and rapidly while providing a ventilation of the tub to prevent accidental suffocation.

It will be apparent to those skilled in the art that various modifications and variations can be made in the present invention without departing from the spirit or scope of the invention. Thus, it is intended that the present invention cover such modifications and variations, provided they come within the scope of the appended claims and their equivalents.

What is claimed is:

1. A drum-type washing machine having a ventilation apparatus providing an air passage for an inner space of a tub to communicate with an atmosphere external of a cabinet of the washing machine, the ventilation apparatus comprising:

a ventilating duct formed at an upper part of the tub;

a ventilating bellows, one end of which is coupled to an exterior surface of the cabinet and the other end of which is connected to said ventilating duct, to allow a passage of air in the tub to the atmosphere external of the cabinet of the washing machine; and bubble dissipation means, vertically installed along the air passage of the ventilation apparatus, for preventing bubbles generated in the tub from being discharged from the cabinet.

2. The drum-type washing machine as claimed in claim 1, wherein said bubble dissipation means is installed in said ventilating duct of the ventilating apparatus.

3. The drum-type washing machine as claimed in claim 1, wherein said bubble dissipation means comprises a float movably disposed in the air passage to travel a predetermined vertical distance along the air passage between a seated state and a raised state, under a force of a forming air bubble, for blocking the air passage when a bubble is generated and allowing the air of the ventilation apparatus to pass freely when no bubble is generated.

4. The drum-type washing machine as claimed in claim 3, wherein an air escape hole having a small cross-section, for allowing air trapped by said float to escape slowly back into said tub, provides communication between the inner space of the tub and a space created when said float is in the raised state.

5. The drum-type washing machine as claimed in claim 3, wherein said bubble dissipation means further comprises:

an air intercepting plate, fixed with respect to the air passage and disposed under said float, for intercepting air passing through said ventilating duct toward said ventilating bellows and thereby preventing a false operation of said float; and a fixed guide, fixed to an inner circumferential surface of the air passage, for guiding the movement of said float along the predetermined vertical distance of the air passage.

6. The drum-type washing machine as claimed in claim 5, wherein said air intercepting plate is fixed to said fixed guide.

7. The drum-type washing machine as claimed in claim 5, wherein said float comprises:

a cylindrical rod to be received by said fixed guide and enable guiding by said fixed guide, said cylindrical rod forming a hollow shaft extending between an open upper end and an open lower end;

a hemispherical head, formed at the open upper end of said cylindrical rod, having a smaller diameter than an inner diameter of the air passage of the ventilation apparatus; and an annular rib, projecting from a lower perimeter of said hemispherical head, having a diameter greater than the inner diameter of the air passage of the ventilation apparatus but having a diameter smaller than the inner diameter of the air passage of the ventilation apparatus.

8. The drum-type washing machine as claimed in claim 7, wherein said hemispherical head and cylindrical rod form an air chamber imparting a buoyancy sufficient to lift said float under the force of a forming air bubble.

9. The drum-type washing machine as claimed in claim 3, wherein said bubble dissipation means further comprises an air intercepting plate, fixed with respect to the air passage of the ventilation apparatus and disposed under said float, for intercepting air passing through said ventilating duct toward said ventilating bellows and thereby preventing a false operation of said float.

10. The drum-type washing machine as claimed in claim 9, wherein said air intercepting plate has an outer diameter greater than that of said float but less than an inner diameter of the air passage of the ventilation apparatus.

11. The drum-type washing machine as claimed in claim 3, wherein said bubble dissipation means further comprises a fixed guide, fixed to an inner circumferential surface of the air passage, for guiding the movement of said float along the predetermined vertical distance of the air passage.

12. The drum-type washing machine as claimed in claim 11, wherein said fixed guide comprises:

a cylindrical sleeve for receiving said float; and a plurality of radial ribs, radiating at a constant interval from said cylindrical sleeve to an inner surface of the air passage, to support said cylindrical sleeve in air passage.

13. The drum-type washing machine as claimed in claim 12, wherein each of said plurality of radial ribs includes a horizontal surface formed next to the inner surface of the air passage and an inclined portion extending from the horizontal surface and sloping upward to said cylindrical sleeve.

14. A washing machine, comprising:

a cabinet;

a tub disposed within the cabinet; and a ventilation apparatus providing an air passage from an inner space of the tube to an atmosphere external to the cabinet, the ventilation apparatus comprising:

a ventilating duct formed at an upper part of the tub;

a ventilating conduit, one end of which is coupled to the cabinet and the other end of which is connected to the ventilating duct; and a bubble dissipation device installed along the air passage, for preventing bubbles generated in the tub from being discharged from the cabinet.

15. The washing machine as claimed in claim 14, wherein the bubble dissipation device is installed in the ventilating duct.

16. The washing machine as claimed in claim 14, wherein the bubble dissipation device comprises a float movably disposed in the air passage to travel between a seated stated and a raised state, under a force of a forming air bubble, for blocking the air passage when a bubble is generated and allowing the air to pass freely when no bubble is generated.

17. The washing machine as claimed in claim 16, wherein an air escape hole having a small cross-section, for allowing air trapped by the float to escape slowly back into the tub, provides communication between the inner space of the tub and a space created when the float is in the raised state.

18. The washing machine as claimed in claim 16, wherein the bubble dissipation device further comprises:

an air intercepting plate, fixed with respect to the air passage and disposed under the float, for intercepting air passing through the ventilating duct toward the ventilating conduit and thereby preventing a false operating of the float; and a fixed guide, fixed to an inner circumferential surface of the air passage for guiding the movement of the float along the air passage.

19. The washing machine as claimed in claim 18, wherein the air intercepting plate is fixed to the fixed guide.

20. The washing machine as claimed in claim 18, wherein the float comprises:

a cylindrical rod to be received by the fixed guide and enable guiding by the fixed guide, the cylindrical rod forming a hollow shaft extending between an open upper end and an open lower end;

a hemispherical head, formed at the open upper end of the cylindrical rod, having a smaller diameter than an inner diameter of the air passage; and an annular rib, projecting from a lower perimeter of the hemispherical head, having a diameter greater than the inner diameter of the air passage but having a diameter smaller than the inner diameter of the air passage.

21. The washing machine as claimed in claim 20, wherein the hemispherical head and cylindrical rod form an air chamber imparting a buoyancy sufficient to lift the float under the force of a forming air bubble.

22. The washing machine as claimed in claim 18, wherein the air intercepting plate has an outer diameter greater than that of the float but less than an inner diameter of the air passage.

23. The washing machine as claimed in claim 18, wherein the fixed guide comprises:

a cylindrical sleeve for receiving the float; and a plurality of radial ribs, radiating at a constant interval from the cylindrical sleeve to an inner surface of the air passage, to support the cylindrical sleeve in the air passage.

24. The washing machine as claimed in claim 23, wherein each of the plurality of radial ribs includes a horizontal surface formed next to the inner surface of the air passage and an inclined portion extending from the horizontal surface and sloping upward to the cylindrical sleeve.

* * * * *